US008029647B2

(12) United States Patent
Leduc et al.

(10) Patent No.: US 8,029,647 B2
(45) Date of Patent: Oct. 4, 2011

(54) METHOD FOR THE PRODUCTION OF PAPER, PAPERBOARD AND CARDBOARD

(75) Inventors: Marc Leduc, Speyer (DE); Rainer Blum, Mannheim (DE); Peter Leifert, Graz (AT)

(73) Assignee: BASF Aktiengesellschaft, Ludwigshafen (DE)

( * ) Notice: Subject to any disclaimer, the term of this patent is extended or adjusted under 35 U.S.C. 154(b) by 729 days.

(21) Appl. No.: 11/574,677

(22) PCT Filed: Sep. 8, 2005

(86) PCT No.: PCT/EP2005/009653

§ 371 (c)(1),
(2), (4) Date: Mar. 5, 2007

(87) PCT Pub. No.: WO2006/027242

PCT Pub. Date: Mar. 16, 2006

(65) Prior Publication Data

US 2008/0000601 A1 Jan. 3, 2008

(30) Foreign Application Priority Data

Sep. 10, 2004 (DE) ..... 10 2004 044 379

(51) Int. Cl.
*D21H 17/45* (2006.01)
*D21H 21/10* (2006.01)

(52) U.S. Cl. ..... 162/164.6; 162/158; 162/168.1; 162/168.2; 162/168.3

(58) Field of Classification Search ..... 162/158, 162/164.6, 166, 168.1–168.3
See application file for complete search history.

(56) References Cited

U.S. PATENT DOCUMENTS

| | | | | |
|---|---|---|---|---|
| 4,421,602 | A | 12/1983 | Brunnmueller et al. | |
| 4,749,444 | A | 6/1988 | Lorz et al. | |
| 5,145,559 | A * | 9/1992 | Auhorn et al. | 162/168.2 |
| 5,274,055 | A * | 12/1993 | Honig et al. | 524/47 |
| 5,393,381 | A | 2/1995 | Hund et al. | |
| 5,858,174 | A * | 1/1999 | Persson et al. | 162/164.1 |
| 6,048,438 | A * | 4/2000 | Rosencrance et al. | 162/158 |
| 6,083,348 | A * | 7/2000 | Auhorn et al. | 162/183 |
| 6,100,322 | A * | 8/2000 | Persson et al. | 524/418 |
| 6,103,065 | A | 8/2000 | Humphreys et al. | |
| 6,273,998 | B1 | 8/2001 | Kuo et al. | |
| 6,303,002 | B1 * | 10/2001 | Linhart et al. | 162/199 |
| 6,576,086 | B1 | 6/2003 | Ettl et al. | |
| 2002/0053413 | A1 | 5/2002 | Zhang et al. | |
| 2003/0192664 | A1 * | 10/2003 | Kulick et al. | 162/164.1 |
| 2007/0004834 | A1 * | 1/2007 | Pakusch et al. | 524/186 |

FOREIGN PATENT DOCUMENTS

| | | |
|---|---|---|
| DE | 102 37 912 | 2/2004 |
| EP | 0 335 575 | 10/1989 |
| EP | 0 235 893 | 5/1990 |
| EP | 0 438 707 | 7/1991 |
| EP | 0 608 896 | 8/1994 |
| EP | 0 649 941 | 4/1995 |
| EP | 0 910 701 | 10/2000 |
| EP | 0 711 371 | 8/2001 |
| WO | 98/01623 | 1/1998 |
| WO | 99/63159 | 12/1999 |
| WO | 99/66130 | 12/1999 |
| WO | 00/58378 | 10/2000 |
| WO | 00/60167 | 10/2000 |
| WO | 01/34910 | 5/2001 |
| WO | 03/050152 | 6/2003 |
| WO | 2004/015200 | 2/2004 |

OTHER PUBLICATIONS

Hagedorn, Roland A., "The combination of highly charged polyelectrolytes with retention agents: retention in the presence of interfering substances", Tappi Journal, pp. 131-134, Aug. 1988.

Auhorn, W. et al., "Untersuchung von Stoersubstanzen in geschlossenen Kreislaufsystemen", Wochenblatt fuer Papierfabrikation, vol. 13, pp. 493-502, 1979.

* cited by examiner

*Primary Examiner* — Matthew J Daniels
*Assistant Examiner* — Dennis Cordray
(74) *Attorney, Agent, or Firm* — Oblon, Spivak, McClelland, Maier & Neustadt, L.L.P.

(57) ABSTRACT

Process for the production of paper, board and cardboard by draining a paper stock on a wire with sheet formation and drying of the sheets, the sheet formation being carried out in the absence of finely divided inorganic flocculants and (a) polymers comprising vinylamine units and/or polyvinylformamide having a molar mass $M_w$ of, in each case, at least 1 million and (b) at least one cationic or nonionic polyacrylamide and/or one cationic or nonionic polymethacrylamide having a molar mass $M_w$ of, in each case, at least 2.5 million being used as retention aids.

20 Claims, No Drawings

METHOD FOR THE PRODUCTION OF PAPER, PAPERBOARD AND CARDBOARD

The invention relates to a process for the production of paper, board and cardboard by draining a paper stock on a wire in the presence of at least one polymer as a retention aid with sheet formation and drying of the sheets.

U.S. Pat. No. 4,421,602 discloses the use of partially hydrolyzed homopolymers of N-vinylformamide as retention aids, drainage aids and flocculants in papermaking.

In addition, it is known that fixing agents can be used in the production of paper from paper stocks comprising impurities, cf. Tappi Journal, August 1988, pages 131-134. Known fixing agents are, for example, condensates of dicyandiamide and formaldehyde or condensates of dimethylamine and epichlorohydrin. EP-A 438 707 furthermore discloses the use of hydrolyzed homo- and/or copolymers of N-vinylfommamide having a degree of hydrolysis of at least 60% as fixing agents in papermaking. They can also be used in combination with a cationic retention aid. The K value of the hydrolyzed polymers of N-vinylformamide is not more than 150 (measured in 5% strength aqueous sodium chloride solution at a polymer concentration of 0.5% by weight and a temperature of 25'C), corresponding to a molar mass $M_w$ of about 900 000.

Further known retention aids are, for example, polyamidoamines which are obtainable by condensation of adipic acid and diethylenetriamine, grafting of the condensates with ethylenimine and crosslinking of the reaction products thus obtainable with bischlorohydrin ethers of polyethylene glycols, and high molecular weight polyethylenimines, high molecular weight polyacrylamides and copolymers of acrylamide and dimethylaminoethyl acrylate methochloride having a molar mass $M_w$ of at least 3 million, cf. examples of EP-A438 707.

According to the teaching of EP-A 649 941, the deposition of impurities in the paper machine, for example on metallic surfaces, wires and felts, is reduced by adding to the paper stock a water-soluble copolymer which comprises at least 5 mol % of an N-vinyicarboxamide or of a hydrolysis product thereof. The degree of hydrolysis of the N-vinylcarboxamides is from 5 to 20 mol % according to the data in the examples.

Moreover, various combinations of polymers and a finely divided, inorganic solid acting as a flocculent, such as bentonite, colloidal silicic acid or silica, are known as retention aids. Thus, the use of cationic polyelectrolytes in combination with bentonite is described, for example, in Wochenblatt für Papieriabrikation, Volume 13, 493-592 (1979). In this process, first bentonite is metered into the paper stock and then the cationic polyelectrolyte, it being possible, if appropriate, to subject the paper stock to a shear gradient.

EP-B 235 893 discloses first adding to a paper stock a synthetic cationic polymer having a molar mass of more than 500 000 in an amount of more than 0.03% by weight, based on dry paper stock, with formation of flocks, which are then broken up into microflocks in a subsequent shear step. Thereafter, bentonite is added and the paper stock thus obtained is drained with sheet formation.

According to the process disclosed in EP-A 335 575 for the production of paper, two different water-soluble, cationic polymers, in particular a fixing agent and a retention aid, are added in succession to the pulp, and the latter is then subjected to at least one shear stage and then treated with bentonite. Only thereafter is the drainage of the pulp with sheet formation effected.

EP-A 711 371 discloses a further process for the production of paper. In this process, a synthetic, cationic, high molecular weight polymer is added to a high-consistency cellulose suspension. After dilution of the flocculated high-consistency pulp, a coagulant which consists of an inorganic coagulant and/or a second, low molecular weight and highly cationic water-soluble polymer is added before draining.

EP-A 910 701 describes a process for the production of paper and cardboard, a low molecular weight or medium molecular weight cationic polymer based on polyethylenimine or polyvinylamine and then a high molecular weight cationic polymer, such as polyacrylamide, polyvinylamine or cationic starch, being added in succession to the paper pulp. After this pulp has been subjected to at least one shear stage, it is flocculated by adding bentonite and the paper stock is drained.

EP-A 608 986 discloses that, in papermaking, a cationic retention aid is metered into the high-consistency pulp. A further process for the production of paper and cardboard is disclosed in U.S. Pat. No. 5,393,381, WO 99/66130 and WO 99/63159, a microparticle system comprising a cationic polymer and bentonite likewise being used. The cationic polymer used is a water-soluble, branched polyacrylamide.

WO 01/34910 describes a process for the production of paper, in which a polysaccharide or a synthetic, high molecular weight polymer is metered into the paper stock suspension. Mechanical shearing of the paper stock must than be effected. The reflocculation is effected by metering an inorganic component such as silicic acid, bentonite or clay, and a water-soluble polymer.

U.S. Pat. No. 6,103,065 discloses a process for improving the retention and the drainage of paper stocks, a cationic polymer having a molar mass of from 100 000 to 2 million and a charge density of more than 4.0 meq/g being added to a paper stock after the final shearing, a polymer having a molar mass of at least 2 million and a charge density of less than 4.0 meq/g being added simultaneously or thereafter, and bentonite then being metered. In this process, it is not necessary to subject the paper stock to shearing after the addition of the polymers. After addition of the polymers and of the bentonite, the pulp can be drained with sheet formation without further action of shear forces.

WO 04/15200 likewise discloses a microparticle system comprising a cationic polymer and a finely divided inorganic component as a retention aid in the production of paper. Suitable cationic polymers are, for example, cationic polyacrylamides, polymers comprising vinylamine units and/or polydiallyldimethylammonium chloride having an average molar mass $M_w$ of, in each case, at least 500 000 and a charge density of not more than 4.0 meq/g.

The microparticle systems described above are too technically complicated because special apparatuses are required for the metering of the finely divided inorganic flocculants.

It is the object of the present invention to provide a further process for the production of paper, a shorter drainage time, an improved filler retention and papers having improved formation being obtained compared with the prior art.

The object is achieved, according to the invention, by a process for the production of paper, board and cardboard by draining a paper stock on a wire in the presence of at least one polymer as a retention aid with sheet formation and drying of the sheets, if the sheet formation is carried out in the absence of finely divided inorganic flocculants and (a) polymers comprising vinylamine units and/or polyvinylformamide having a molar mass $M_w$ of, in each case, at least 1 million and (b) at least one cationic or nonionic polyacrylamide and/or one cationic or nonionic polymethacrylamide having a molar mass $M_w$ of, in each case, at least 2.5 million are used as retention aids.

Polymers comprising vinylamine units and/or polyvinylformamide having a molar mass $M_w$ of, in each case, at least 1 million are known. They are prepared, for example, by homopolymerization of N-vinylformamide to give poly-N-vinylformamide or by copolymerization of N-vinylformamide with at least one other ethylenically unsaturated monomer and subsequent hydrolysis of the polymerized vinylformamide units to vinylamine units. Preferred polymers comprising vinylamine units are the cationic polymers obtainable by hydrolysis of poly-N-vinylformamides. The degree of hydrolysis of these polymers is, for example, from 0.5 to 100%, preferably from 1 to 50%, and is in general in the range from 2 to 40, in particular from 2 to 30, %. The polymers of component (a) have, for example, a charge density (determined at pH 7) of from 0 to 18 meq/g, preferably from 0.1 to 7 meq/g and in particular from 0.2 to 4 meq/g. The polymers comprising vinylamine units and poly-N-vinylformamides of component (a) of the retention aid preferably have a molar mass $M_w$ of at least 1.2 million. The preparation of homo- and copolymers of N-vinylformamide having the above-mentioned specifications is described in detail, for example, in U.S. Pat. No. 6,132,558, column 2, line 36 to column 5, line 25. The statements made there are hereby incorporated by reference.

Either a polymer comprising vinylamine units or poly-N-vinylformamide, alone or as a mixture with polymers from the two classes of compounds, may be used as component (a). However, cationic polymers comprising vinylamine units are preferred as compounds of component (a).

Cationic polyacrylamides, nonionic polyacrylamides, cationic polymethacrylamides, nonionic polymethacrylamides and mixtures of said compounds are suitable as component (b) of the retention aid system, provided that they have in each case a molar mass $M_w$ of at least 3 million. Polymers of this type are described in EP-A 335 575, mentioned in connection with the prior art. In addition, such polymers are commercial products. They are known to be prepared by polymerization of acrylamide or methacrylamide, in each case alone, to give homopolymers or by polymerization of acrylamide or methacrylamide in the presence of cationic monomers.

Suitable cationic monomers are, for example, the esters and amides of ethylenically unsaturated $C_3$- to $C_5$-carboxylic acids with amino alcohols. Examples of cationic monomers are dimethylaminoethyl acrylate, diethylaminoethyl acrylate, dimethylaminoethyl methacrylate, diethylaminoethyl methacrylate, dimethylaminopropyl acrylate, diethylaminopropyl acrylate, dimethylaminopropyl methacrylate, diethylaminopropyl methacrylate, dimethylaminoethylacrylamide, diethylaminoethylacrylamide, dimethylamineethylmethacrylamide, diethylaminoethylmethacrylamide, dimethylaminopropylacrylamide, dimethylaminopropylmethacrylamide and diethylaminopropylmethacrylamide.

The cationic monomers can be used in the copolymerization in the form of the free bases, of the salts with mineral acids, such as sulfuric acid, hydrochloric acid or phosphoric acid, of the salts with organic acids, such as formic acid, acetic acid, propionic acid, benzenesulfonic acid or p-toluenesulfonic acid, and/or in quaternized form. Suitable quaternizing agents are, for example, $C_1$- to $C_{18}$-alkyl halides, such as methyl chloride, ethyl chloride, n-propyl chloride, isopropyl chloride and/or stearyl chloride and benzyl chloride.

The cationic polyacrylamides or the cationic polymethacrylamides comprise, for example, from 5 to 40 mol %, preferably from 7 to 30 mol %, of at least one cationic monomer incorporated in the form of polymerized units. The molar masses of the cationic polymers and those of the nonionic polymer are at least 2.5 million, preferably at least 3 million, and are in general in the range from 5 million to 15 million.

According the invention, for example, (a) at least one polymer which comprises vinylamine units and is obtainable by hydrolysis of polymers comprising vinylformamide units, the degree of hydrolysis of the vinylformamide units being from 0.5 to 100% and (b) a copolymer of (i) from 95 to 60 mol % of acrylamide and/or methacrylamide and (ii) from 5 to 40 mol % of at least one cationic monomer are used as retention aids.

The retention aid comprises, in particular, as component (a) a hydrolyzed polyvinylformamide having a degree of hydrolysis of from 1 to 40% and a molar mass $M_w$ of at least 1.2 million and as component (b) a copolymer of from 93 to 70 mol % of acrylamide and from 7 to 30 mol % of at least one cationic monomer having a molar mass of at least 2.5 million.

The cationic polyacryamides and the cationic polymethacrylamides preferably comprise, as the cationic monomer, dimethylaminoethyl acrylate methochloride or dimethylaminoethylacrylamide methochloride incorporated in the form of polymerized units. These methochlorides are readily obtainable by alkylation of dimethylaminoethyl acrylate or of dimethylaminoethylacrylamide with methyl chloride.

The components (a) and (b) of the retention aid are added to the paper stock in an amount of (a) from 0.001 to 0.8% by weight, preferably from 0.01 to 0.5% by weight and (b) from 0.001 to 0.8% by weight, preferably from 0.01 to 0.2% by weight, based on dry paper stock. Although the ratio of the components (a) and (b) can be chosen as desired, from 0.1 to 1.0, preferably from 0.25 to 0.4, part by weight of component (b) is preferably used per part by weight of component (a). The retention aid can be added to the paper stock—as a rule, the metering of the retention aid is effected, according to the invention, into the low-consistency pulp—for example in the form of a mixture of the components (a) and (b). However, it is also possible to adopt a procedure in which first, for example after the last shear stage before the headbox, the component (a) is metered and then the component (b) is metered. However, the two components can also be introduced into the low-consistency pulp separately from one another but simultaneously, before or after a shear stage. Most advantageously, first at least one compound of component (a) and then at least one compound of component (b) are metered. The compound of component (a) can be fed to the paper stock, for example, before a shear stage and the compound of component (b) can be fed to the paper stock after the last shear stage before the headbox. However, the two compounds can also be metered to the paper stock before the last shear stage before the headbox or after the last stage before the headbox. However, the component (a) can also be metered into the low-consistency pulp at different points and shear forces can be allowed to act on the system and the component fed in before the last shear stage before the headbox or thereafter. It is also possible first to add the components (b) to the paper stock and then to meter the component (a) of the retention aid.

If polyvinylformamide is used as a compound of component (a), a cationic polyacrylamide is preferably used as a compound of component (b); if, on the other hand, a polymer comprising vinylamine units is chosen as component (a), the use of a cationic polyacrylamide or of a cationic polymethacrylamide is preferred but a nonionic polyacrylamide and/or nonionic polymethacrylamide can also be used as component (b).

The invention also relates to the use of combinations of (a) polymers comprising vinylamine units and/or polyvinylformamide having a molar mass $M_w$ of in each case, at least 1 million and (b) at least one cationic or nonionic polyacrylamide and/or one cationic or nonionic polymethylacrylamide having a molar mass $M_w$ of, in each case, at least 2.5 million as the sole retention aid in the production of paper, board and cardboard.

According to the invention, all paper qualities, board and cardboard can be produced, for example papers for newsprint, so-called medium-fine writing and printing papers, natural gravure printing papers and also light-weight coating papers. For example, groundwood, thermomechanical pulp (TMP), chemothermomechanical pulp (CTMP), pressure groundwood (PGW) and sulfite and sulfate pulp may be used. Chemical pulp and mechanical pulp as well as waste paper and coated broke are also suitable as raw materials for the production of the pulp. Mechanical pulp and chemical pulp are further processed in more or less moist form, directly without prior thickening or drying, especially in the integrated paper mills, to give paper. Because the impurities have not been completely removed therefrom, these fiber materials still comprise substances which greatly interfere with the conventional papermaking process. If such paper stocks are used, it is advisable to work in the presence of a fixing agent.

Both filler-free and filler-comprising papers can be produced by the process according to the invention. The filler content in the paper may be up to not more than 40% by weight and is preferably in the range from 5 to 30% by weight. Suitable fillers are, for example, clay, kaolin, natural and precipitated chalk, titanium dioxide, talc, calcium sulfate, barium sulfate, alumina, satin white or mixtures of said fillers.

The papermaking can be carried out in the presence of the conventional process chemicals in the conventional amounts, for example of engine sizes, such as, in particular, alkyldiketene dispersions, rosin size, alkenylsuccinimide dispersions or sizing polymer dispersions, strength agents, such as polyamidoamines crosslinked with epichlorohydrin, polyvinylamines of average molecular weight or starch, fixing agents, biocides, dyes and fillers. The metering of the conventional process assistants is preferably effected into the low-consistency pulp.

Compared with the products which are produced by known processes, papers having improved formation, improved filler distribution, better opacity and improved printability are obtained by the process according to the invention. Compared with the microparticle processes, the process according to the invention is simpler to carry out and gives filler retention and formation which are improved compared with the prior art.

In the examples, the stated percentages for the starting materials are always percent by weight. The molar masses $M_w$ of the polymers were determined with the aid of static light scattering.

The drainage time was determined by draining a sample of the paper stock in a Schopper-Riegler tester and determining the time in seconds within which 300 ml of filtrate were obtained.

The determination of the ash retention (first pass ash retention) was effected by calculating the difference between the ash concentration of the paper stock in the headbox and the ash concentration in the white water, divided by the ash concentration of the paper stock in the headbox and multiplied by 100. It is stated in percent.

The assessment of the formation (on-line formation index) was effected by measuring the sheets to be tested with the aid of a Measure IT Optical Properties Measurement OP 4255 (formation sensor from ABB). The lower the measured value, the better the formation.

In the examples, the following polymers were used:

PVAm 1: Polyvinylamine having a molar mass $M_w$ of 1.2 million and a charge density of 3.0 meq/g PAM 1: Copolymer of 70% by weight of acrylamide and 30% by weight of dimethylaminoethyl acrylate methochloride having a molar mass $M_w$ of 8 million and a charge density of 1.7 meq/g The bentonite used had been activated with aqueous sodium carbonate solution.

EXAMPLES

In each case a paper stock comprising 50% of TMP, 30% of deinked waste paper, 20% of bleached kraft pulp and calcium carbonate as a filler and the additives stated in example 1 and in comparative examples 1 to 3 was drained on a twin wire paper machine which produced wood-comprising printing paper at a speed of 1500 m/min. The solids content of the white water was always 0.55%. The filler content of the paper was 30%. The paper had a basis weight of 52-56 g/m$^2$.

Example 1

0.03% of PVAm 1 and 0.01% of PAM 1 were added to the abovementioned paper stock after the last shear stage and before the headbox. The drainage time was seconds, the ash retention was 42% and the formation index was 5.9.

Comparative Example 1

According to the teaching of EP-A 235 893, 0.04% of PVAm 1 and 0.015% of PAM 1 were metered into the paper stock described above before the last shear stage, followed by 0.3% of bentonite before the headbox. The drainage time of a sample comprising the bentonite was 38 seconds, the ash retention was 37% and the formation index was 6.9.

Comparative Example 2

0.025% of PAM 1 was metered into the paper stock described above after the last shear stage and before the headbox. The drainage time of this paper stock was 41 seconds, the ash retention was 36% and the formation index was 7.4.

Comparative Example 3

0.05% of PVAm 1 was metered into the paper stock described above after the last shear stage and before the headbox. The drainage time of this paper stock was 38 seconds, the ash retention was 39% and the formation index was 6.4.

We claim:

1. A process for producing paper, board or cardboard comprising:

draining a paper stock on a wire with sheet formation which is carried out in the absence of a finely divided inorganic flocculant and in the presence of a retention aid to obtain a sheet, wherein the retention aid comprises:

(a) at least one hydrolyzed polyvinylformamide having a degree of hydrolysis of 0.5-50% and a weight average molar mass $M_w$ of at least 1,200,000, which is prepared by homopolymerizing N-vinylformamide to give poly-N-vinylformamide and subsequently hydrolyzing 0.5-50% of the vinylformamide units to vinylamine units, which is cationic, and which has a charge density of 0.2-4 meq/g; and (b) at least one cationic poly(meth)acrylamide copolymer having a weight average molar mass $M_w$ of at least 3,000,000 and comprising 70-93 mol. % of acrylamide and 7-30 mol. % of at least one cationic monomer, wherein the cationic monomer is selected from the group consisting of dimethylaminoethyl acrylate and dimethylaminoethyl methacrylate, including free bases, salts and/or quaternized forms thereof, wherein a weight ratio of component (b) to component (a) is 0.25-0.4; and drying the sheet obtained from said sheet formation.

2. The process according to claim 1, wherein the cationic monomer is dimethylaminoethyl acrylate methochloride.

3. The process according to claim 1, wherein the retention aid comprises:

(a) 0.001-0.8 wt. % of the hydrolyzed polyvinylfomamide; and (b) 0.001-0.8 wt. % of the cationic poly(meth)acrylamide copolymer.

4. The process according to claim 1, wherein the retention aid comprises:

(a) 0.01-0.5 wt. % of the hydrolyzed polyvinylformamide; and (b) 0.01-0.2 wt. % of the cationic poly(meth)acrylamide copolymer.

5. The process according to claim 1, wherein the hydrolyzed polyvinylformamide has a degree of hydrolysis of 1-40%.

6. The process according to claim 1, wherein the hydrolyzed polyvinylformamide has a degree of hydrolysis of 2-30%.

7. The process according to claim 1, wherein the cationic poly(meth)acrylamide copolymer has a weight average molar mass $M_w$ of 5,000,000 to 15,000,000.

8. The process according to claim 1, wherein the retention aid comprises:

(b) a mixture comprising: the cationic poly(meth)acrylamide copolymer; and at least one nonionic poly(meth) acrylamide copolymer having a weight average molar mass $M_w$ of at least 3,000,000.

9. The process according to claim 8, wherein the retention aid comprises:

(a) 0.001-0.8 wt. % of the hydrolyzed polyvinylformamide; and (b) 0.001-0.8 wt. % of the mixture.

10. The process according to claim 8, wherein the retention aid comprises:

(a) 0.01-0.5 wt. % of the hydrolyzed polyvinylformamide; and (b) 0.01-0.2 wt. % of the mixture.

11. A process for producing paper, board or cardboard comprising:

draining a paper stock on a wire with sheet formation which is carried out in the absence of a finely divided inorganic flocculant and in the presence of a retention aid to obtain a sheet, wherein the retention aid comprises:

(a) at least one hydrolyzed polyvinylformamide having a weight average molar mass $M_w$ of at least 1,200,000, which is prepared by homopolymerizing N-vinylformamide to give poly-N-vinylformamide and subsequently hydrolyzing the vinylformamide units to vinylamine units, which is cationic, and which has a charge density of 0.2-4 meq/g; and (b) at least one cationic poly(meth)acrylamide copolymer having a weight average molar mass $M_w$ of at least 3,000,000 and comprising 70-93 mol. % of acrylamide and 7-30 mol. % of at least one cationic monomer, wherein the cationic monomer is selected from the group consisting of dimethylaminoethyl acrylate and dimethylaminoethyl methacrylate, including free bases, salts and/or quaternized forms thereof, wherein a weight ratio of component (b) to component (a) is 0.25-0.4; and drying the sheet obtained from said sheet formation.

12. The process according to claim 11, wherein the cationic monomer is dimethylaminoethyl acrylate methochloride.

13. The process according to claim 11, wherein the retention aid comprises:

(a) 0.001-0.8 wt. % of the hydrolyzed polyvinylformamide; and (b) 0.001-0.8 wt. % of the cationic poly(meth)acrylamide copolymer.

14. The process according to claim 11, wherein the retention aid comprises:

(a) 0.01-0.5 wt. % of the hydrolyzed polyvinylformamide; and (b) 0.01-0.2 wt. % of the cationic poly(meth)acrylamide copolymer.

15. The process according to claim 11, wherein the hydrolyzed polyvinylformamide has a degree of hydrolysis of 0.5-50%.

16. The process according to claim 11, wherein the hydrolyzed polyvinylformamide has a degree of hydrolysis of 1-40%.

17. The process according to claim 11, wherein the cationic poly(meth)acrylamide copolymer has a weight average molar mass $M_w$ of 5,000,000 to 15,000,000.

18. The process according to claim 11, wherein the retention aid comprises:

(b) a mixture comprising: the cationic poly(meth)acrylamide copolymer; and at least one nonionic poly(meth) acrylamide copolymer having a weight average molar mass $M_w$ of at least 3,000,000.

19. The process according to claim 18, wherein the retention aid comprises:

(a) 0.001-0.8 wt. % of the hydrolyzed polyvinylformamide; and (b) 0.001-0.8 wt. % of the mixture.

20. The process according to claim 18, wherein the retention aid comprises:

(a) 0.01-0.5 wt. % of the hydrolyzed polyvinylformamide; and (b) 0.01-0.2 wt. % of the mixture.

* * * * *